362-110 SR
XR 4,000,403

United States Patent [19]
Rice

[11] 4,000,403
[45] Dec. 28, 1976

[54] MULTI-PURPOSE LIGHT

[76] Inventor: Marion D. Rice, Box 167, Brady, Tex. 76825

[22] Filed: July 3, 1975

[21] Appl. No.: 592,737

Related U.S. Application Data

[63] Continuation of Ser. No. 421,102, Dec. 3, 1973, abandoned.

[52] U.S. Cl. ..... 240/2 F; 240/6.41; 240/10.61; 240/10.63

[51] Int. Cl.[2] ..... F21V 33/00; F21V 7/00

[58] Field of Search ..... 240/2 F, 7.5, 7.55, 240/6.4 F, 41 M, 10.6 R, 10.63, 10.68, 52.1, 73, 732 D, 6.41, 10.65, 10.61; 33/241

[56] References Cited

UNITED STATES PATENTS

| | | | |
|---|---|---|---|
| 1,170,012 | 1/1916 | Smith | 240/10.63 |
| 1,197,131 | 9/1916 | Kribs | 240/10.63 |
| 1,333,077 | 3/1920 | Jackson | 240/10.61 |
| 1,452,651 | 4/1923 | Norrlin | 240/6.41 |
| 1,609,147 | 11/1926 | White | 240/52.1 X |
| 1,825,127 | 6/1932 | McKeen | 240/6.41 X |
| 2,027,961 | 1/1936 | Currie | 240/10.6 X |
| 2,320,917 | 6/1943 | Ely | 240/10.61 |
| 3,087,052 | 4/1963 | Torgerson | 240/10.63 X |
| 3,488,488 | 1/1970 | Crouch | 240/6.41 |
| 3,601,595 | 8/1971 | Kivela | 240/10.63 X |
| 3,672,939 | 10/1973 | Hunter | 117/75 |
| 3,739,167 | 6/1973 | Avery | 240/6.41 X |

FOREIGN PATENTS OR APPLICATIONS

| | | | |
|---|---|---|---|
| 191,603 | 9/1937 | Switzerland | 240/2 F |

*Primary Examiner*—L. T. Hix
*Assistant Examiner*—E. M. O'Connor
*Attorney, Agent, or Firm*—David L. Moseley

[57] ABSTRACT

In accordance with the present invention, a sealed beam, high intensity light is housed in a metal case provided with a bracket to one side and the bracket is bolted to an elongated base member that is semicircular in cross-section. A synthetic resin is molded on the inside of the base member to the precise shape and taper of the barrel of a gun, and the assembly is coated with a layer of vinyl resin to provide a nonconductive, corrosion proof surfacing. The length of base member is of a dimension to fit between the two upstanding terminals of a typical 12 volt lantern battery. The light can be mounted underneath the barrel of a gun by clamps positioned at each end of base member and encircling the barrel, or the light can be mounted on top of a lantern battery by two z-shaped clips held by the terminal nuts. The base member also provides a convenient grip to adapt the light for use as a hand spotlight.

6 Claims, 4 Drawing Figures

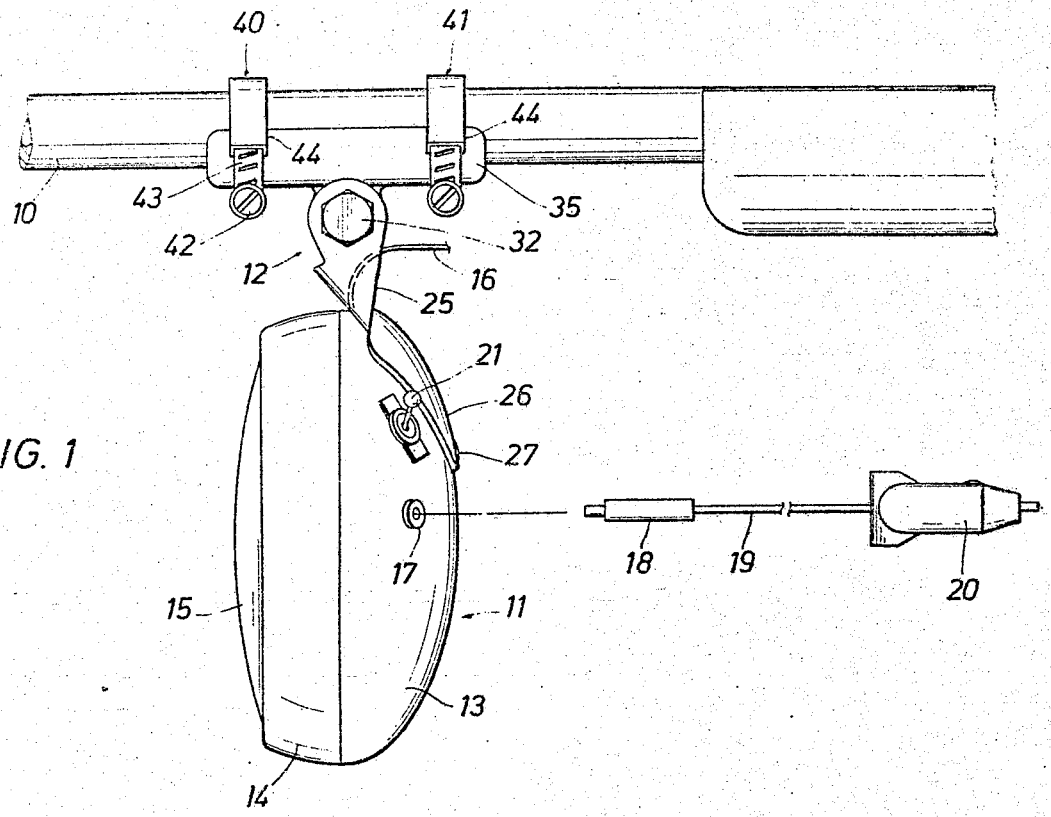
FIG. 1
FIG. 2
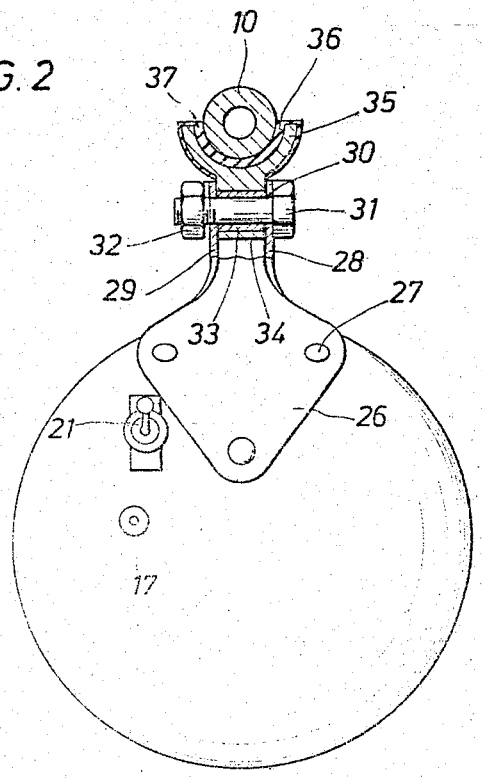
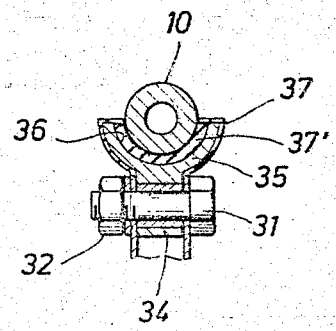
FIG. 3

MULTI-PURPOSE LIGHT

This application is a continuation of application Ser. No. 421,102, filed Dec. 3, 1973, now abandoned.

This invention relates generally to illuminating devices, and particularly to a new and improved light instrument that is arranged to be mounted on the barrel of a firearm in such a manner as to illuminate a target. In addition, the mounting assembly for the light is particularly adapted to be attached to the top of a lantern battery, for use in various outdoor activities such as camping or as a trouble light for a motorist.

In law enforcement endeavors as well as in hunting for wild game and the like, there is a need for a simple, inexpensive and efficient mean for lighting the target of a firearm, such as a rifle or shotgun, at night. Although devices of this type have been proposed in the past, all such devices as are known to the applicant suffer from a number of shortcomings. For example U.S. Pat. No. 1,452,651 shows a flashlight that is mounted on the barrel of a pistol, however such a source of light is obviously not adequate for most purposes, and the mounting arrangement is not particularly sturdy which is a highly undesirable feature. Moreover, the flashlight is mounted on the top side of the barrel which provides an obstruction along the line of sight of the gun. The Barns U.S. Pat. No. 957,299 shows a light that is mounted underneath the barrel of a gun, however, the mounting incorporates a massive bracket that again interferes with the line of sight along the barrel. In addition, this disclosure teaches the use of a light source that is not considered to provide adequate visibility under most conditions where such a device would be useful. Yet another known device mounts on the scope of a rifle and in such a manner that a sturdy and rigid coupling to the gun is not necessarily achieved. Shims may be provided to mount a light directly on the barrel of the gun, however such an arrangement is considered to be highly inconvenient from the standpoint of the user and would impose assembly difficulties that are avoided in accordance with the concepts of the present invention. Moreover, the various devices noted above have been arranged for use only in connection with a firearm, yet it will be apparent that there are many other circumstances where a high intensity light would be of great utility, for example as a trouble light for a motorist, or to illuminate a camping area at night.

Accordingly, it is an object of the present invention to provide a new and improved light instrument that is easily attached to the barrel of a firearm in a simple and convenient manner.

Another object of this invention is to provide a new and improved means to mount a light on the barrel of a gun, the mount being easily and quickly attached by the user and resulting in a very strong and sturdy assembly.

Another object of the present invention is to provide a new and improved mounting of the type described above that is attached to the gun barrel with structural means that do not provide an obstruction to the line of sight.

Still another object of the present invention is to provide a new and improved mounting assembly for a high intensity light whereby the light can be mounted either on the barrel of a rifle or on top of a lantern battery in such a manner as to provide lighting for general outdoor purposes such as camping.

These and other objects are attained in accordance with the concepts of the present invention through the provision of an electric lamp of relatively high power that is arranged to be mounted on the barrel of a gun by means including an elongated metallic base member to which the lamp housing is rigidly coupled by a bracket. The base member has a generally semicircular cross-section providing an internal recess with a diameter that preferably is greater than the diameter of the companion gun barrel to which the device is to be fixed. A synthetic risen material is provided within the recess and is formed or molded to provide a cavity having the precise dimension and taper of the barrel, and all of the exterior surface of the base member are coated with a vinyl resin material that provides a protection against corrosion and is electrically nonconductive. The base member and lamp are secured to the barrel by spaced apart clamps, one near each end of the base member, that preferably are thin metal bands that surround both the barrel and the clamping plate and can be tightened in a convenient manner. The assembly allows the lamp to be mounted underneath the barrel in such a manner that the clamps do not interfere with, or project into, the line of sight along the barrel. Preferably, protective means such as plastic tubing is disposed around each clamp adjacent to the barrel to protect the surface finish of the latter against damage.

The length of the base member is sized so that it will fit in between the two upstanding terminals of a typical lantern battery. A clip connected to each terminal interfits with an end portion of the base member to hold the assembly and light rigidly on top of the battery case. The semicircular section of the base member provides spaced apart, parallel surfaces in contact with the case for a stable construction, and the nonconductive nature in the coating material on the base prevents electrical shorting. The terminals nuts are screwed down against the clips to hold them tightly against the end portions of the base member with the lead wire connectors underneath.

It has been found that the use of a synthetic resin coating for the base member provides a strong gripping action against the barrel, which, together with the action of the clamps provides an extremely sturdy and rigid mounting arrangement that aleviates the problems discussed above with respect to prior art devices. The light can be quickly assembled onto either the barrel or a lantern battery as noted above with a minimum of effort on the part of the user, providing a multiple purpose instrument.

The present invention has other objects, features and advantages which will become more clearly apparent in connection with the following detailed description of a preferred embodiment, taken in conjunction with the appended drawings in which:

FIG. 1 is a side view of the lighting instrument assembled with the barrel of a gun;

FIG. 2 is a back view of the instrument or FIG. 1 and with parts of the mounting assembly shown in cross-section;

FIG. 3 is a fragmentary cross-sectional view of the base member and molded interior.

Figure 4:
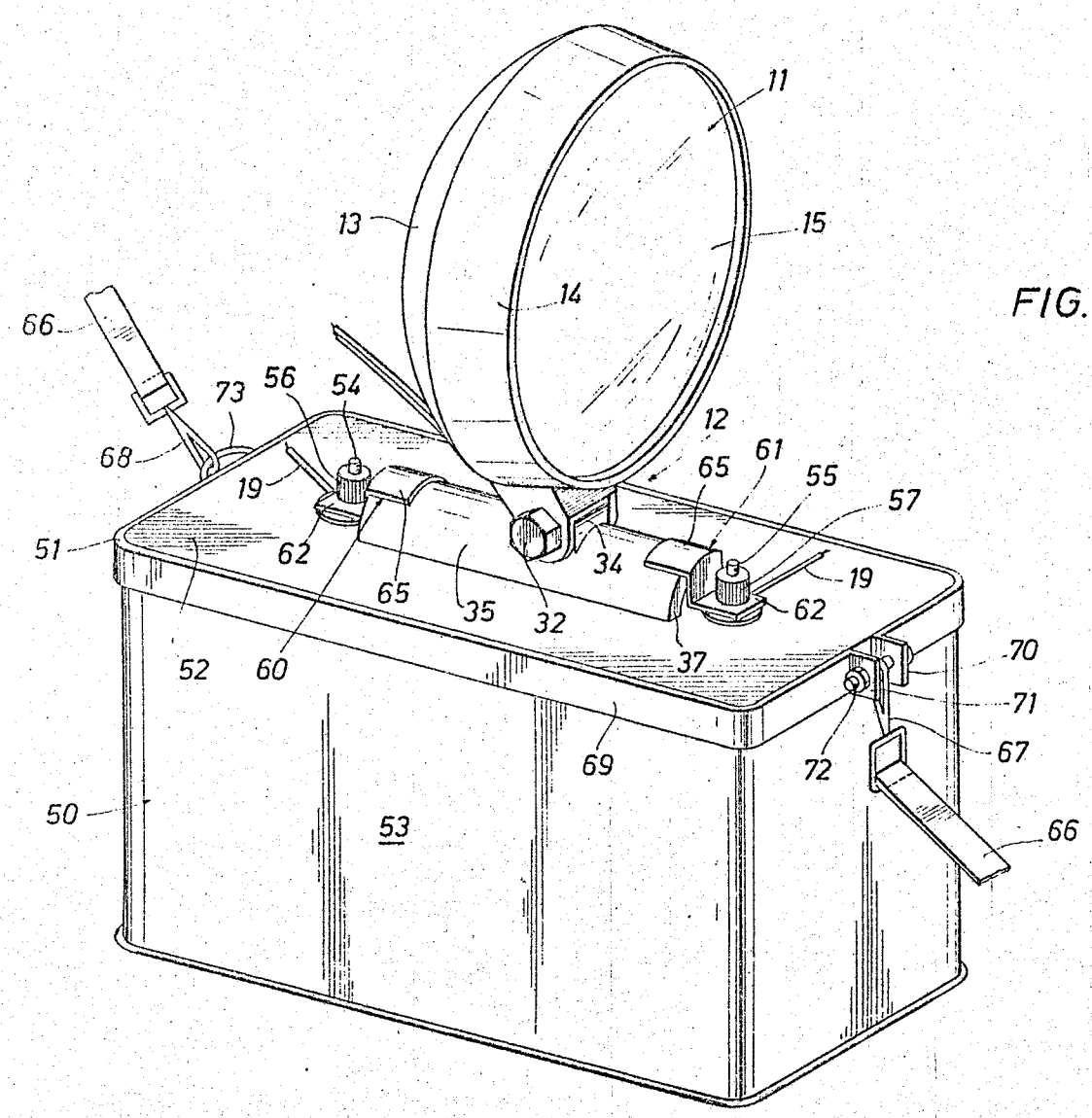
FIG. 4 is an isometric view of the light and bracket assembly mounted on top of a lantern battery in accordance with other aspects of the present invention.

Referring initially to FIG. 1, there is shown an overall view of an illuminating device that is constructed in accordance with the principles of the present invention. The barrel 10 of a rifle or other firearm has an electric flood lamp assembly 11 fixed thereto by a mounting bracket assembly indicated generally at 12. The assembly 11 comprises a metal lamp housing 13 which together with a retainer plate 14 houses a light globe 15. The light 15 is preferably a sealed beam unit capable of putting out light of substantial luminous intensity, for example globes are available in various powers in the range 35,000 to 110,000 candlepower. Electric power to the lamp is fed in through a two-conductor wire 16 that leads to a battery pack (not shown) that is carried, for example, on the user's belt. As an alternative method of powering the light 15, a plug-in socket 17 is located on the rear of the housing 13 and will accept a male plug 18. The wire 19 leading from the plug 18 has a plug-in adapter 20 that is arranged to be mated with the cigarette lighter socket on the dashboard of an automobile. The details of the adapter 20 are well known and need not be set forth here. A toggle switch 21, also on the rear of the housing 13, is used to turn the light 15 on and off, and the connections to the socket 17 are arranged such that when the plug 18 is inserted, the power from the battery pack is automatically cut off. Thus, if the plug 18 is removed for any reason, accidentally or otherwise, the light 15 will remain on as long as the switch 21 is on.

A bracket 25 is formed with a curved plate 26 that is fixed to the housing 13 by rivets 27 or the like. The outer end of the bracket 25 is shaped to provide spaced apart side members 28 and 29 as shown in FIG. 2, with openings 30 sized to receive a bolt 31 with a nut 32 on its threaded end. The bolt 31 is fitted through a pivot support bushing 32 that is received within an ear 34 formed on the lower side of an elongated base member 35. Thus the lamp bracket 25 and the lamp assembly 12 normally are rigidly attached to the clamping plate 35.

The base 35, shown in side view in FIG. 1 and in transverse section in FIG. 2, is an elongated member having a semicircular configuration providing an internal recess 36 that preferably is sized to have a greater diameter than the diameter of the adjacent section of the gun barrel 10. In accordance with one of the features of the present invention, the base member 35 is molded or coated on the inside with a vinyl resin material 37 such as polyvinyl chloride, the material being molded to fit the precise size and taper of the barrel 10. In some cases, as shown in FIG. 3, a thermosetting resin material 37′ such as polyester or an epoxy is used as a filler material with an overlaying coating of vinyl resin. The resin material 37 is coated over almost the entire outer surface of the base member 35 to add protection against corrosion, as well as to provide an insulation preventing electrical shorting as will become more fully apparent hereafter. The coating 37 acts as a protective agent between the barrel 10 and clamping plate 35, and acts as a gripping agent to result in an extremely rigid mount.

In order to rigidly secure the coated base member 35 to the barrel 10, and thus provide a sturdy and rugged mounting for the light assembly 11, clamp members 40 and 41 are disposed near each respective end of the base member 35. In a preferred embodiment, the clamps 40 and 41 are each formed of a thin metal band whose circumferential dimension can be changed by adjustment of a screw 42 having threads that engage inclined slots 43 in the straps. Such clamping elements per se are well known, however their use in the combination of this device has been found to be particularly advantageous because they provide an easily adjustable means of attachment having a lower profile that is out of the way of the line of sight along the top of the barrel 10. Moreover, in order to protect the surface and blueing of the barrel 10 against scuffing or other damage, thin protective sheaths 44 of heat-shrinkable polyvinylchloride tubing can be disposed on each of the bands 40 and 41 and positioned for contact with the barrel 10.

An assembly of the apparatus of the present invention onto the gun barrel 10 can be accomplished with extreme ease and with a minimum of tools, even with a small coin or the like. The clamping plate 35 with the clamp members 41 and 42 loosely adjusted are slid over the gun barrel into the desired position with the light disposed underneath, whereupon the protective strips 44 are located and the clamps 40 and 41 tightened. The plastic coating 37 provides a strong gripping action against the barrel 10 to obtain a sturdy and tight interfit that for all practical purposes precludes any relative movement with ordinary usage and handling of the gun. In fact, it has been found that the mounting bracket assembly 12 will support many times the weight of the gun without appreciable movement, and will withstand the recoil of a large caliber rifle, for example, without readjustment. The light 15 provides ample illumination so that objects can be sighted at great distances at night. As previously mentioned, the light can be powered by a battery pack belted to the user, for example, or can be powered from the electrical system of an automobile.

Another utilization of the present invention is shown in FIG. 4, where the light 11 and the mounting bracket 12 are shown conveniently attached to the top of a typical 12 volt D.C. lantern battery 50. The battery 50 has a metal outer case that provides an outstanding upper rim or edge 51 formed in the process of joining the top plate 56 of the case to the side wall 53. The terminals 54 and 55 of the battery are in the form of upstanding, threaded pins adapted to receive nuts 56 and 57. The base member 35 of the mounting bracket 12 is longitudinally dimensioned to fit between the terminals 54, 55, and the thermoplastic coating 37, being non-conducting, prevents electrical shorting. The base member 35 is rigidly fixed with respect to the battery 50 by z-shaped metal clips 60 and 61, each having a bare apertured portion 62 that fits over a respective terminal, and a plastic coated tang portion 65 with downwardly curved edges that press against the top of the member 37 when the terminal nuts 56 and 57 are tightened down. The lead wires 19 from the light 15 are provided with typical wishbone connections that fit around the terminals 54 and 55 below the clips 60 and 61 in order to make electrical connection with the battery 60.

A carrying strap 66 made of leather or the like has its two ends connected by snap latches 67 and 68 to a thin metal band 69 of plated metal. The band 69 is shaped and sized to fit snugly around the battery case in such a manner that its upper end abuts against the rim 51. The band 69 is discontinuous at one end and has outwardly turned portions 70 and 71 with aligned holes which receive a bolt 72 having a companion nut (not shown). The nut and bolt can be tightened to obtain a tight fit of the band 69 around the case. The latch 67 can be snapped onto the bolt 72 between the end portion 70 and 71, and a D-ring 73 connected to the opposite side of the strap 69 receives the other latch 68. In this manner, the light can be carried over the shoulders of the user, or otherwise handled in a convenient fashion. The particular location of the strap or band 69 against the upper edge of the battery case provides an arrangement wherein the center of gravity is below the attachment points for the strap 66, so that the light 11 will not tend to tip over when it is carried by the strap but will remain upright in a highly desirable manner.

It will be further recognized that when the light assembly 11 is dismounted from either the battery 50 or the gun barrel 10, the nut 32 can be loosened to enable the base member 35 to be tilted upwardly until its rear portion is underneath the housing 13. The base member 35 and the bracket 25 then provide a convenient hand grip so that the assembly can be used as a hand-held spotlight.

Since certain changes or modifications may be made by those skilled in the art without departing from the inventive concepts involved herein, it is the aim of the appended claims to cover all such changes or modification falling within the true spirit and scope of the present invention.

I claim:

1. An illuminating device adapted to be attached to the barrel of a firearm, comprising: an electric lamp; housing means for containing said lamp; and means for mounting said housing means and said lamp underneath the barrel of a firearm including an elongated tubular base member semicircular in section to provide a recess extending axially along the upper side thereof, said base member having forward and rearward portions, ear means on the lower side of said base member and having aperture means extending transversely thereof, bracket means on said housing means adapted to interfit with said ear means, means extending through said aperture means for rigidly attaching said bracket means to said ear means with said lamp means being selectively directed, said recess having a greater diameter than the corresponding diameter of the barrel of a firearm to which said housing means and said lamp may be mounted, plastic coating means covering substantially all of the external surfaces of said base member and being molded within said recess to the precise shape and taper of the barrel of a firearm to enable a snug interfit therewith, and clamp means for tightly securing said base member to the barrel of a firearm, said clamp means comprising first band means encircling said forward portion of said base member and adapted to encircle a firearm barrel and second band means encircling said rearward portion of said base member and adapted to encircle a firearm barrel.

2. The device of claim 1 wherein each of said first and second band means has a thin wall section and is provided with screw operated means for reducing its circumferential dimension to effect a tightening action.

3. The device of claim 2 further including protective means on each band to prevent damage to the surface of a firearm barrel.

4. The device of claim 1 wherein said plastic coating means comprises a thermosetting resin material molded within the confines of said recess to provide a filler, and an overlaying coating of thermoplastic material covering said filler as well as substantially all the remaining external surfaces of said base member.

5. An illuminating device comprising: an electric lamp; housing means for encasing said lamp; a mounting assembly for securing said lamp and said housing means to a lantern battery including a bracket attached to said housing means, an elongated tubular base member semicircular in section to provide spaced-apart coplanar support surfaces along the lower side thereof, ear means on the upper side of said base member, said ear means having an aperture, bracket means on said housing means adapted to interfit with said ear means, and means extending through said aperture means for rigidly attaching said bracket means to said ear means with said lamp means being selectively directed; said base member being adapted to be fixed to a lantern battery of the type having an upper end surface and upstanding spaced-apart terminals, said base member having a longitudinal dimension substantially equal to the clearance between the terminals of a lantern battery whereby said base member may fit closely therebetween with said support surfaces engaging the upper end surface of a lantern battery; electrical insulation means covering said base member; and clip means adapted to be mounted on each of the terminals of a lantern battery and having a portion engaging said base member to firmly fix said housing means and said mounting assembly to a lantern battery.

6. The device of claim 5 further including a metal band adapted to surround the uppermost outer portion of a lantern battery; and an elongated flexible strap having its ends attached to said band at oppositely located points to provide a means for carrying said illuminating device in an upright position.

* * * * *